US010612267B2

(12) United States Patent
Nelson

(10) Patent No.: US 10,612,267 B2
(45) Date of Patent: Apr. 7, 2020

(54) ARTICLE AND DRINK SHELTERING ASSEMBLY

(71) Applicant: Amy Nelson, Victoria, MN (US)

(72) Inventor: Amy Nelson, Victoria, MN (US)

( * ) Notice: Subject to any disclaimer, the term of this patent is extended or adjusted under 35 U.S.C. 154(b) by 0 days.

(21) Appl. No.: 16/246,075

(22) Filed: Jan. 11, 2019

(65) Prior Publication Data

US 2019/0218813 A1 Jul. 18, 2019

Related U.S. Application Data

(60) Provisional application No. 62/618,698, filed on Jan. 18, 2018.

(51) Int. Cl.

| | |
|---|---|
| ***E04H 15/38*** | (2006.01) |
| ***E04H 15/02*** | (2006.01) |
| *A47G 23/00* | (2006.01) |

(52) U.S. Cl.

CPC ..... *E04H 15/02* (2013.01); *E04H 15/38* (2013.01); *A47G 23/00* (2013.01)

(58) Field of Classification Search

CPC ..... E04H 15/38

See application file for complete search history.

(56) References Cited

U.S. PATENT DOCUMENTS

| | | | | |
|---|---|---|---|---|
| 2,036,033 | A * | 3/1936 | Fisher | E04H 15/003 135/133 |
| 2,266,853 | A * | 12/1941 | Dabney | E04H 15/003 135/126 |
| 2,543,597 | A * | 2/1951 | Peery | A45F 4/04 135/95 |
| 2,811,977 | A * | 11/1957 | McClish | E04H 15/001 297/184.14 |
| 2,832,361 | A * | 4/1958 | Smith | E04H 15/003 135/130 |
| 3,242,935 | A * | 3/1966 | Williams | A01K 97/22 135/132 |
| 5,058,757 | A | 10/1991 | Proa | |
| 5,186,196 | A | 2/1993 | Gorka | |
| 8,459,494 | B2 | 6/2013 | Dewinetz | |
| 2004/0131801 | A1* | 7/2004 | Wong | A01K 1/033 428/12 |
| 2008/0142062 | A1 | 6/2008 | Carrieri | |
| 2012/0012144 | A1 | 1/2012 | Cebular | |

FOREIGN PATENT DOCUMENTS

| | | |
|---|---|---|
| DE | 202015006 | 11/2015 |
| GB | 2543111 | 4/2017 |
| WO | WO2015107238 | 1/2014 |

* cited by examiner

*Primary Examiner* — Noah Chandler Hawk

(57) ABSTRACT

An article and drink sheltering assembly includes a frame including a plurality of supports and a base. Each of the supports is attached to the base. The supports are pivotally coupled to the base and are positionable in a deployed condition extending upwardly from the base or in a collapsed condition lying on the base. The frame has a height, length and width each being less than 20.0 inches when the frame is in the deployed condition. The supports at least include a first support and a second support. The first support defines a front support and forms an opening into the beverage shelter assembly when the first support is in the deployed condition. A cover of flexible material is attached to the frame. The cover extends over and is attached to each of the supports to define a canopy when the frame is in the deployed condition.

1 Claim, 8 Drawing Sheets

ARTICLE AND DRINK SHELTERING ASSEMBLY

CROSS-REFERENCE TO RELATED APPLICATIONS

I hereby claim the benefit under 35 U.S.C. Section 119(e) of U.S. Provisional application 62/618,698 filed on Jan. 18, 2018.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to weather elements shading devices and more particularly pertains to a new weather elements shading device for protecting small articles such as electronics and beverages from sun, water, and wind.

In particular, the device of the present invention may be used to position beverages and small electronics directly adjacent to a pool where these objects would otherwise be heated by sunlight. Aside from direct sunlight, the pool skirting itself is often very warm due to being warmed by the sun. As such, it not favorable to place cell phones and beverages on the ground adjacent to the water since this heat will damage cell phones and make beverages unsavory as they become too warm and any ice therein melts. It would also be advantageous to protect beverages and small electronics from being splashed with water as well as reduce the chances of these articles being accidentally spilled, stepped upon, or kicked into the water.

BRIEF SUMMARY OF THE INVENTION

An embodiment of the disclosure meets the needs presented above by generally comprising a frame including a plurality of supports and a base. Each of the supports is attached to the base. The supports are pivotally coupled to the base and are positionable in a deployed condition extending upwardly from the base or in a collapsed condition lying on the base. The frame has a height, length and width each being less than 20.0 inches when the frame is in the deployed condition. The supports at least include a first support and a second support. The first support defines a front support and forms an opening into the beverage shelter assembly when the first support is in the deployed condition. A cover comprised of flexible material is attached to the frame. The cover extends over and is attached to each of the supports to define a canopy when the frame is in the deployed condition.

In another embodiment, the invention includes a frame having a plurality of supports and a base. Each of the supports is attached to the base and the supports are pivotally coupled to the base to be positionable in a deployed condition extending upwardly from the base or in a collapsed condition lying on the base. The base has a rear edge, a front edge, a first lateral edge and a second lateral edge. The supports are engaged with the first and second lateral edges of the base. The supports at least include a first support and a second support. The first support defines a front support and is positioned adjacent to the front edge of the base to form an opening into the beverage shelter assembly. The first support lies in plane forming an angle with a plane of the base between 80° and 100° when the first support is in the deployed condition. The second support defines an intermediate support and is positioned adjacent between the rear edge of the base and the first support. A cover comprised of flexible material is attached to the frame. The cover extends over and is attached to each of the supports. The cover is attached to the base and extends upwardly from each of the rear, first lateral and second lateral edges. The cover defines a canopy when the frame is in the deployed condition.

In yet another embodiment, a method is disclosed providing a shelter which includes a frame having a plurality of supports and a base. Each of the supports is pivotally attached to the base so that the supports are positionable in a deployed condition extending upwardly from the base or in a collapsed condition lying on the base. The frame has a height, length and width each is less than 20.0 inches when the frame is in the deployed condition. The base has a rear edge, a front edge, a first lateral edge and a second lateral edge. The supports are engaged with the first and second lateral edges of the base. The supports at least including a first support and a second support, wherein the first support defines a front support positioned adjacent to the front edge of the base to form an opening into the beverage shelter assembly. The first support lies in plane forming an angle with a plane of the base between 80° and 100° when the first support is in the deployed condition. The second support defines an intermediate support and is positioned adjacent between the rear edge of the base and the first support. A cover comprised of flexible material is attached to the frame and extends over and is attached to each of the supports. The cover is attached to the base and extends upwardly from each of the rear, first lateral and second lateral edges. The cover defines a canopy when the frame is in the deployed condition. The shelter is placed adjacent to a pool and a beverage positioned within the shelter so that the beverage is shielded from sunlight.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
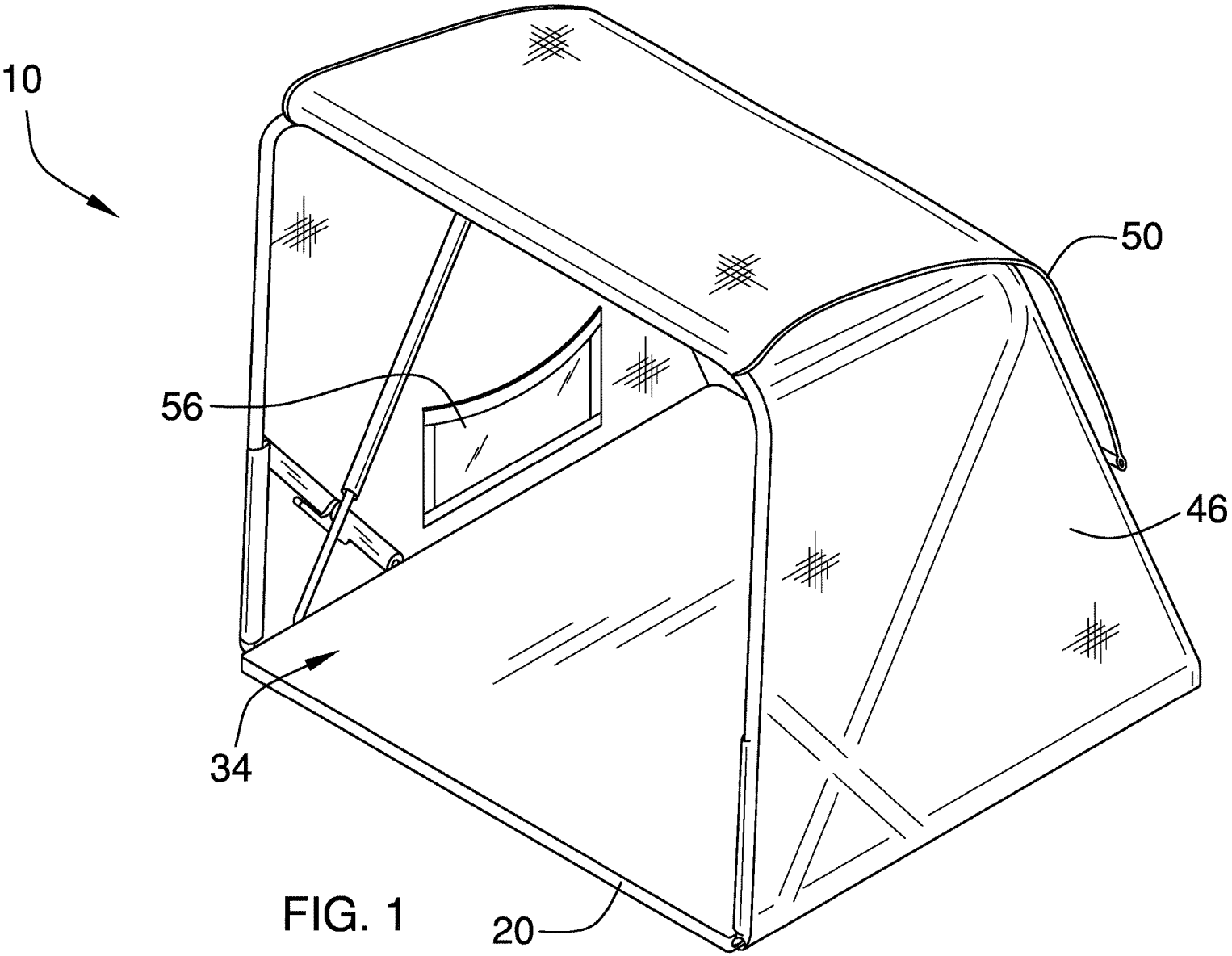
FIG. 1 is a front right isometric view of an article and drink sheltering assembly according to an embodiment of the disclosure.
Figure 2:
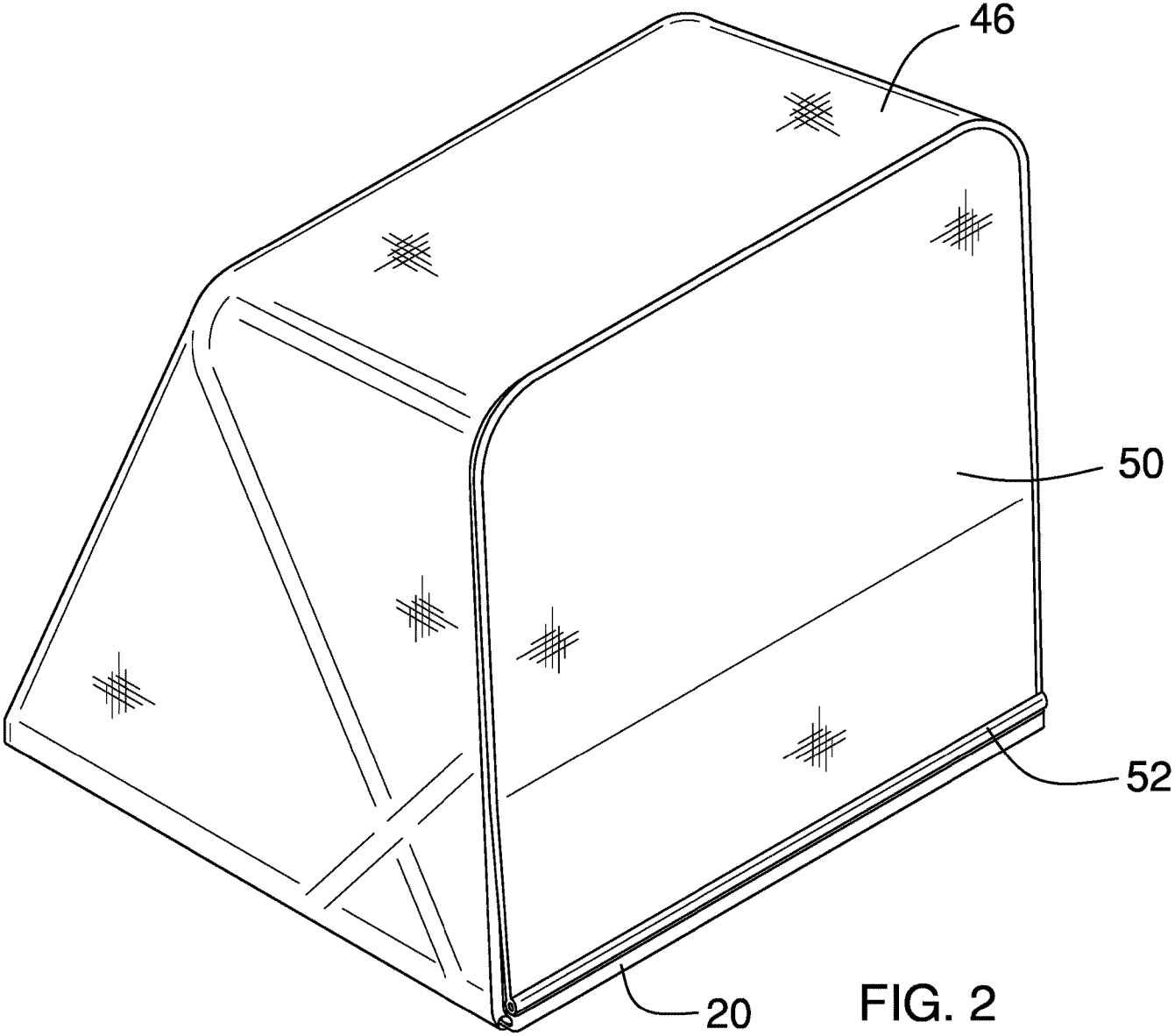
FIG. 2 is a left front right isometric view of an embodiment of the disclosure.
Figure 3:
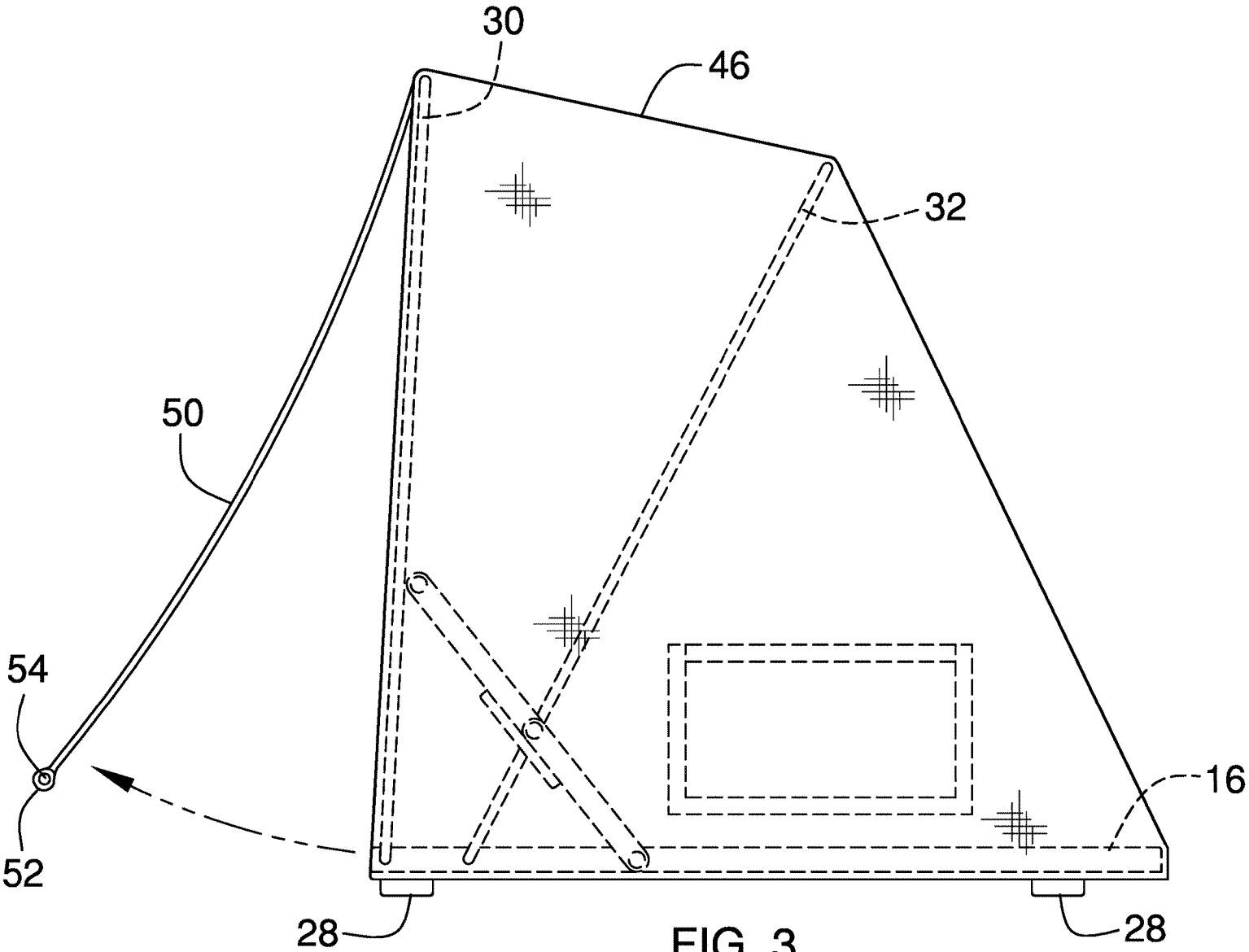
FIG. 3 is a right side view of an embodiment of the disclosure.

With reference now to the drawings, and in particular to FIGS. 1 through 8 thereof, a new weather elements shading device embodying the principles and concepts of an embodiment of the disclosure and generally designated by the reference numeral 10 will be described.

As best illustrated in FIGS. 1 through 8, the article and drink sheltering assembly 10 generally comprises a frame 12 including a plurality of supports 14 and a base 16. Each of the supports 14 is attached to the base 16. The supports 14, more typically, will be pivotally coupled to the base 16 and positionable in a deployed condition extending upwardly from the base 16 or in a collapsed condition lying on the base 16. The base 16 has a rear edge 18, a front edge 20, a first lateral edge 22 and a second lateral edge 24. The supports 14 are engaged with the first 22 and second 24 lateral edges of the base 16. The frame 12 has a height, length and width each is less than 20.0 inches when the frame 12 is in the deployed condition. Specifically, the deployed condition frame 12 height will usually at least be between 14.0 inches and 16.0 inches to accommodate tall beverage bottles such as wine bottles and the like as well as tall beverage glasses including wine glasses.

Figure 5:
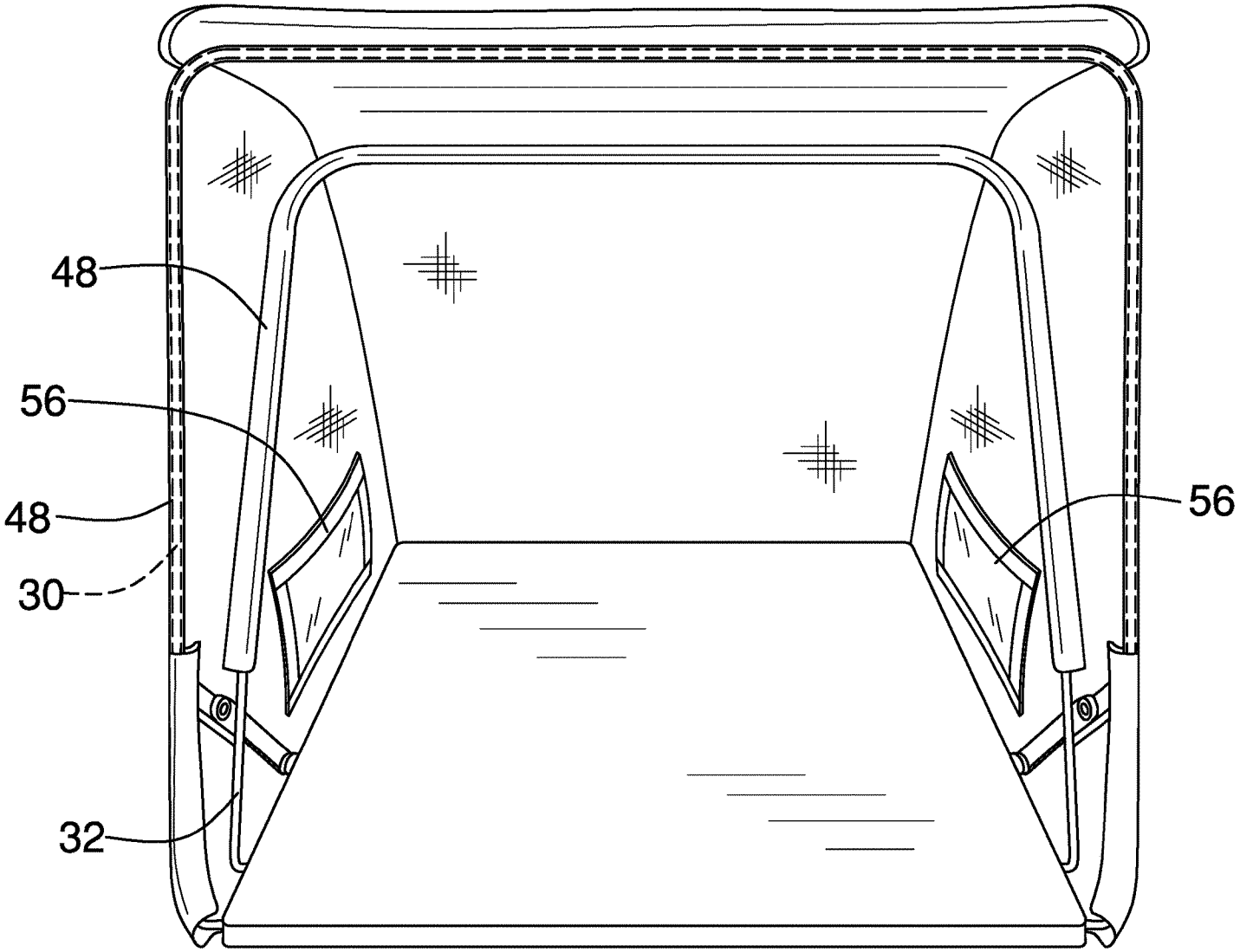
FIG. 5 is a front view of an embodiment of the disclosure.

The base 16 may be comprised of a rigid, rectangular shaped panel as is shown in FIG. 5. However, it should be understood that the base 16 may be formed from a perimeter band of material similar to the supports 14 and in a rectangular shape. If the base 16 is formed into a rigid panel, the panel may be comprised of metal, plastics, elastomers, wood or other like materials. A plurality of feet 28 may be attached to and extend downwardly from a bottom side 26 of the base 16 and extend downwardly therefrom a distance typically less than 2.0 inches. The feet 28 may comprise an anti-skid material such as an elastomer. Alternatively, legs may be provided which would allow a user to anchor the frame 12 into soft material, such as sand, wherein the base 16 may be spaced from the sand to allow easy access thereto when a person is sitting in a chair adjacent to the frame. However, the assembly 10 is generally provided for use while a person is in a pool and therefore there will be no preference to have the base 16 to be significantly lifted off of a surface on which it is positioned.

The supports 16 at least include a first support 30 and a second support 32. The first support 30 defines a front support and is positioned adjacent to the front edge 20 of the base 16 to form an opening 34 into the article and drink sheltering assembly 10. The first support 30 lies in plane forming an angle with a plane of the base 16 between 80° and 100° when the first support 30 is in the deployed condition. The second support 32 defines an intermediate support and is positioned between the rear edge 18 of the base 16 and the first support 30. The second support 32 lies in plane forming an angle with a plane of the base 16 between 75° and 30° when the second support 32 is in the deployed condition. Each of the first 30 and second 32 supports lie in planes forming an angle with the plane of the base 16 being less than 15° when the first 30 and second 32 supports are in the collapsed condition. It should be understood that a plurality of additional supports 14 may be utilized and therefore three, four, five or more supports 14 may be foldable into each other. Thus there may be additional intermediate supports between the first 30 and second 32 supports and rear supports positioned rearwardly of the second support 32.

Figure 4:
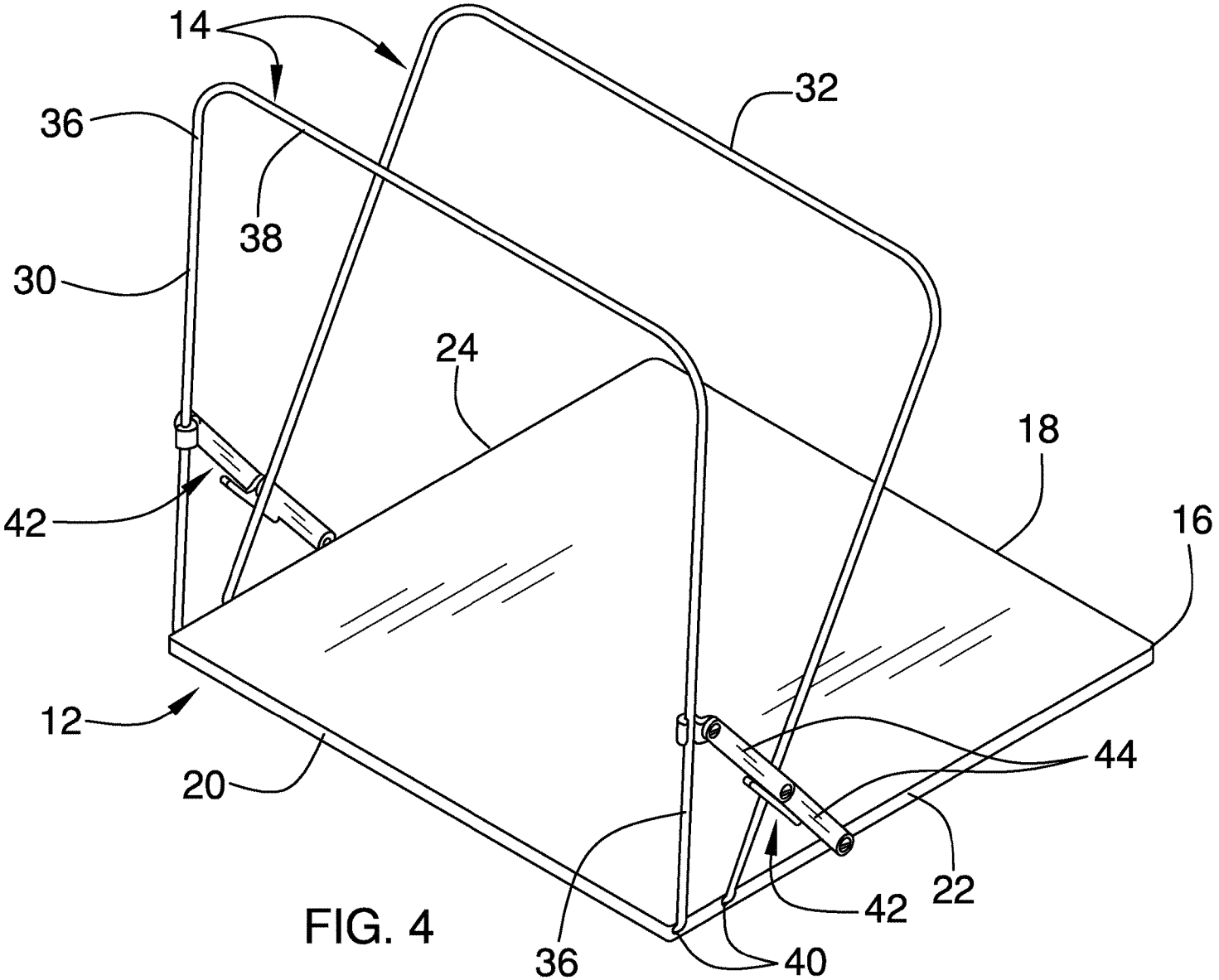
FIG. 4 is a right isometric view of a frame of an embodiment of the disclosure.

As shown most clearly in FIG. 4, each of the first 30 and second 32 supports includes a pair of leg sections 36 and a medial section 38 that is attached to and extends between associated ones of the leg sections 36 such that each of the first 30 and second 32 supports are U-shaped. Each of the leg sections 36 has a distal end 40 with respect to an associated one of the medial sections 38. The distal ends 40 are pivotally coupled to the base 16. This may be accomplished by any conventional means including spindles or providing bends adjacent to the distal ends 40 so that they extend into the first 22 and second 24 lateral edges. The supports 14 are typically comprised of a metallic or plastic material that is either rigid or resiliently bendable.

Figure 8:
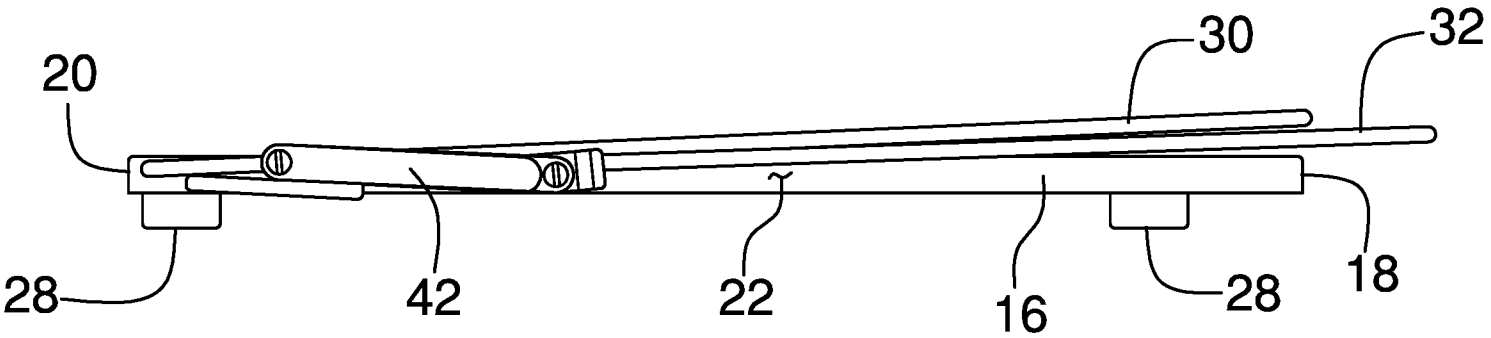
FIG. 8 is a side view of an embodiment of the disclosure of the frame in a collapsed position.

A locking member 42 engages the first support 30 and releasably retains the first support 30 in the deployed condition. The locking member 42 extends from and is attached to the first support 30 and the base 16. The locking member 42 will typically be pivotally coupled to the base 16 so that it can be folded down when the frame 12 is in the collapsed condition. The locking member 42 may include any type of conventional buttressing or securing device and might for instance comprise a locking hinge that includes a pair of sections 44 pivotally coupled to each other that will collapse when the entire frame 12 is collapsed as is shown in FIG. 8. As can be seen in FIG. 4, a pair of locking members 42 may be utilized wherein each leg 36 of the first support 30 has one of the locking members 42 attached thereto. Locking members 42 may also be used with all supports 14 if deemed necessary for stability. Alternatively, the legs 36 of the first support 30 may be lockable into slots, not shown, in the base 16 to retain the legs 36 in an upright position and thus a locking member 42 would not be needed.

A cover 46 is provided that is comprised of flexible material which is attached to and covers the frame 12. The cover 46 extends over and is attached to each of the supports 14 by any conventional means. As can be seen in FIG. 5, the supports 14 may extend through sleeves 48 attached to the cover 46. However, ties, clips, stitching or other structure commonly used to secure supporting members 14 to cloth may be employed. The cover 46 is attached to the base 16 and extends upwardly from each of the rear 18, first lateral 22 and second lateral 24 edges. The cover 46 may be wrapped around the base 16 and secured to the bottom thereof. The base 16 may be secured to the cover 46 in a permanent manner such as by chemical or physical bonding, or may be removable attached to the base 16 by means of mechanical fasteners such as snaps, buttons, hook and loop connectors, and the like. The cover 46 defines a canopy when the frame 12 is in the deployed condition and will be formed of material which preferably resists damage from UV light and may be water resistant.

A flap 50 is attached to the cover 46 and is positionable in a closed position covering the opening 34 or in an open position exposing the opening 34. The flap 50 extends along an upper edge of the cover 46 adjacent to the first support 30. The flap 50 will likely be comprised of a flexible material, which may include the same material used for the cover 50. Furthermore, the flap 50 may form a unitary structure with the cover 46. The flap 50 has a free edge 52 which is positioned adjacent to the front edge 20 of the base 16 when the flap 50 is in the closed position. A closure or retention member may be utilized to retain the flap 50 in the closed position such that it does not easily move in windy conditions. This may be accomplished, for instance, by use of a weighted rod 54 positioned in or adjacent to the free edge 52. Other retention members may be utilized such as magnets positioned in the flap 50 which are magnetically attracted to ferromagnetic materials in or on the base 16 adjacent to the front edge 20.

A pocket 56 is mounted to an inner surface of the cover 46 such that the pocket 56 is positioned within the enclosure and accessible when the frame 12 is in the deployed condition. The pocket 56 is positioned to hold small electronic devices, personal items, wallets and the like, and in particular cellular phones 58. The pocket 56 will keep these items off of base in the event fluids spill onto the base 16 and retain the base 16 in an uncluttered space to lower the risk of container spillage within the assembly 10. As can be seen in FIG. 5, more than one pocket 56 may be positioned on the cover 46 and in particular may be positioned on lateral walls thereof.

Figure 6:
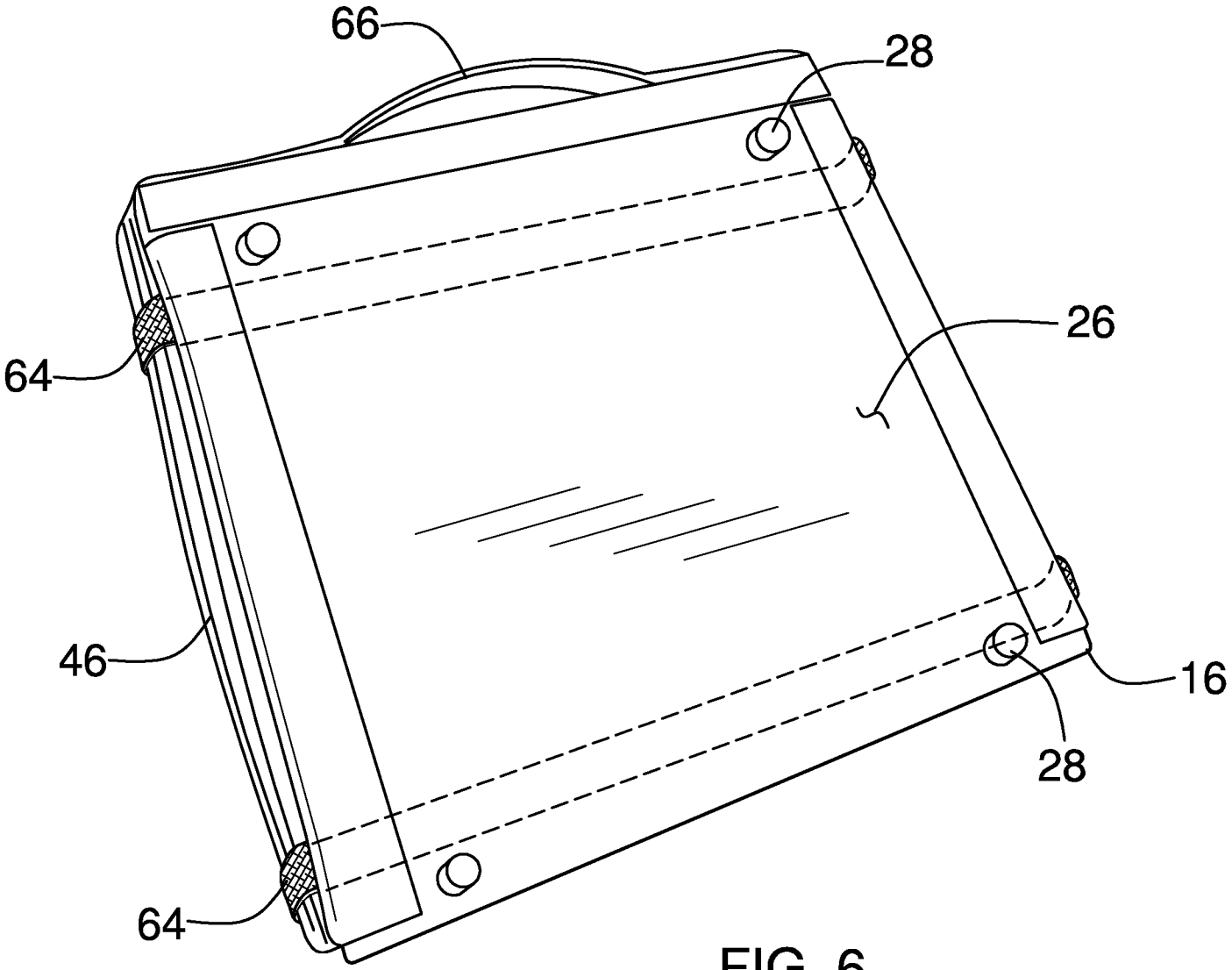
FIG. 6 is a bottom view of an embodiment of the disclosure in a collapsed condition.
Figure 7:
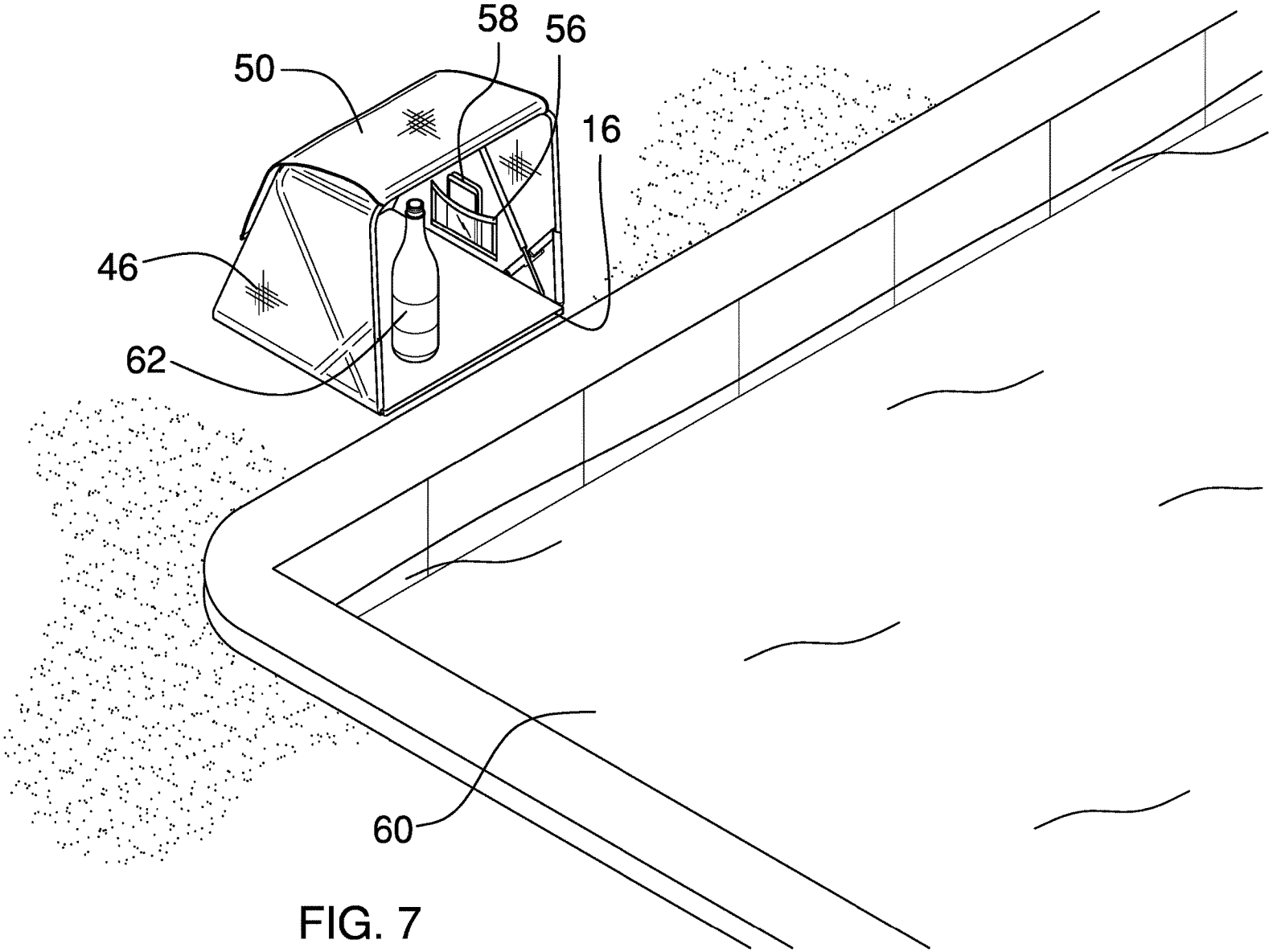
FIG. 7 is a front left isometric view of an embodiment of the disclosure in use.

In use, when a person wishes to be in a pool 60 and therefore be spaced away from foliage, umbrellas and other sources of shade, the assembly 10 is set up adjacent to the pool 60 and placed in the deployed condition so that beverages 62 or other articles can be placed in the interior of the assembly 10. The cover 46 shades these items so that electronic devices do not overheat and beverages 62 do not become warm or watered down by melted ice. The assembly 10 also protects these devices from splashing water, being blown over by wind, and helps to keep flying insects, and in particular bees, from entering beverages 62. When the assembly 10 is not being used, it is collapsed and may be held in such a position by elastic bands 64 which may be attached to the cover 46 or base 16 and extended around the frame 12. As can be seen in FIG. 6, a handle 66 may be attached to the assembly 10, either on the base 16 or on the cover 46 adjacent to the back edge 18 of the base 16, to facilitate carrying of the assembly 10 during transportation thereof.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A method of protecting a beverage from weather elements, said method comprising the steps of:

providing a shelter, said shelter including:

a frame including a plurality of supports and a base, each of the supports being attached to the base, the supports being pivotally coupled to the base and being positionable in a deployed condition extending upwardly from the base or in a collapsed condition lying on the base, the frame having a height, length and width each being less than 20.0 inches when the frame is in the deployed condition, the base having a rear edge, a front edge, a first lateral edge and a second lateral edge, the supports being engaged with the first and second lateral edges of the base, the supports at least including a first support and a second support, the first support defining a front support and being positioned adjacent to the front edge of the base to form an opening into the beverage shelter assembly, the first support lying in plane forming an angle with a plane of the base between 80° and 100° when the first support is in the deployed condition, the second support defining an intermediate support and being positioned adjacent between the rear edge of the base and the first support;

a cover comprised of flexible material being attached to the frame, the cover extending over and being attached to each of the supports, the cover being attached to the base and extending upwardly from each of the rear, first lateral and second lateral edges, the cover defining a canopy when the frame is in the deployed condition;

placing the shelter adjacent to a pool; and positioning a beverage within the shelter so that the beverage is shielded from sunlight.

* * * * *